United States Patent [19]

Berger et al.

[11] 4,031,016

[45] June 21, 1977

[54] BASE OIL COMPOSITIONS HAVING IMPROVED LIGHT STABILITY

[75] Inventors: Hans Berger; Gerhard De Lind Van Wijngaarden; Jacobus H. Breuker, all of Amsterdam, Netherlands

[73] Assignee: Shell Oil Company, Houston, Tex.

[22] Filed: Dec. 15, 1975

[21] Appl. No.: 641,052

[52] U.S. Cl. ..... 252/50; 252/399; 252/401

[51] Int. Cl.[2] ..... C10M 1/34

[58] Field of Search ..... 252/50, 399, 401

[56] References Cited

UNITED STATES PATENTS

| | | | |
|---|---|---|---|
| 3,480,635 | 11/1969 | Altwicker | 252/50 |
| 3,530,076 | 9/1970 | Sparks et al. | 252/401 |
| 3,585,139 | 6/1971 | Ryer et al. | 252/50 |
| 3,594,319 | 7/1971 | Vollmann et al. | 252/50 |

OTHER PUBLICATIONS

Chem. Abs., 81 26140 & 26141, Rabek et al.

*Primary Examiner*—C. Davis

[57] ABSTRACT

The daylight stability of hydroprocessed oils is improved by adding thereto (1) singlet oxygen quenchers suitably selected from the class consisting of carotenes, aliphatic amines and heterocyclic amines, and (2) certain aromatic secondary amines as antioxidants.

18 Claims, No Drawings

BASE OIL COMPOSITIONS HAVING IMPROVED LIGHT STABILITY

BACKGROUND OF THE INVENTION

It is known to perform a hydroprocessing step, e.g. hydrocracking and/or hydrofinishing, in the manufacture of base oils. The disadvantage of such hydroprocessed oils, in particular hydrocracked base oils, is that they are unstable to daylight, i.e. to short wave-length light characteristic of daylight. Exposure of hydroprocessed base oils to daylight usually produces one or more of the following undesirable effects: darkening, haze formation and sludge formation. Attempts have been made to overcome this disadvantage by blending the base oil with various other oils, for instance, non-hydroprocessed oils, but such other oils have to be used in quite large amounts, e.g., in excess of 5 %w, which can influence the properties of the base oils. Attempts have also been made to overcome this disadvantage by including additives in the hydroprocessed base oils. For example, U.S. Pat. No. 3,702,299 discloses the use of orthohydroxybenzophenones and aliphatic primary amines and U.S. Pat. No. 3,756,943 discloses the use of hindered phenols, amines and Mannich condensation products from phenols, aldehydes and polyamines.

SUMMARY OF THE INVENTION

It has now been discovered that the daylight stability of hydro-processed base oils may be significantly improved by adding thereto a novel combination of additives.

According to the present invention, improved daylight stability is obtained with a base oil composition comprising a major proportion of a hydroprocessed base oil and a minor proportion of 1. a compound of the general formula:

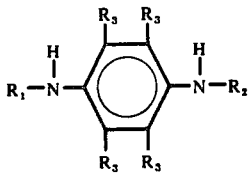

(I)

wherein $R_1$ is a substituted or unsubstituted aliphatic, aromatic or heterocyclic group; $R_2$ is hydrogen or the same group as $R_1$ and $R_3$, which may be the same or different groups, is hydrogen or an alkyl group; and 2. a singlet oxygen quencher.

Suitable singlet oxygen quenchers include carotenes, aliphatic amines, and four to eight membered ring heterocyclic amines which may or may not have alkyl radical substituents.

The invention is useful for improving the daylight stability of hydrofinished and hydrocracked base oils but is particularly useful for improving the daylight stability of hydrocracked or hydrocracked and hydrofinished base oils.

DESCRIPTION OF THE PREFERRED EMBODIMENTS

The hydroprocessed oils may be derived from mixtures of hydrocarbons derived from the heavy petroleum fractions obtained by pyrolysis of coal, bituminous shale or tar sand, but are preferably derived from crude oil e.g. vacuum distillate fractions, de-asphalted petroleum fractions or slack wax. The petroleum fractions boiling, at least in part, above the boiling range of lubricating oil may be advantageously used, although those within the lubricating oil boiling range may be used as well.

In general, hydrofinishing is a mild hydrogenation treatment under conditions which depend upon the nature of the feedstock but usually comprises contacting the feedstock with hydrogen in the presence of a hydrogenation catalyst at a temperature typically between 150° and 350° C and at a pressure typically between 10 and 200 bars. The treatment is usually carried out in addition to a conventional solvent extraction step. Hydrofinishing does not usually increase the viscosity index of the feedstock.

In general, hydrocracking is a more severe treatment under conditions which depend upon the nature of the feedstock but usually comprises contacting the feedstock with hydrogen in the presence of a hydrogenation catalyst, which may be the same or different catalyst from that which is used in hydrofinishing, at a temperature typically between 350° and 500° C and at a pressure typically between 60 and 200 bars. Hydrocracking is usually performed in place of a conventional solvent extraction step. Hydrocracking usually increases the viscosity index of the feedstock and is used in the preparation of high, very high and extra high viscosity index lubricating base oils.

In general, if the feedstock is subjected to a hydrocracking treatment followed by a hydrofinishing treatment, the conditions for both treatments are similar to those described above for hydrocracking except that the hydro-finishing temperature is at least 25° below the cracking temperature.

The present invention is particularly suitable for improving the daylight stability of hydroprocessed base oils having viscosity indices in the range of from 80 to 155.

The daylight stability of hydroprocessed base oils is improved by adding thereto a daylight stability enhancing amount of 1. a compound of the general formula:

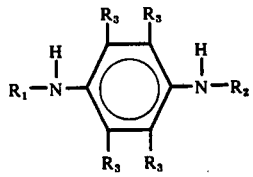

(I)

in which $R_1$ is substituted or unsubstituted aliphatic, aromatic, or a four to eight membered heterocyclic group comprised of from one to five heteroatom selected from the class of nitrogen, oxygen, phosphorus and sulfur; $R_2$ is hydrogen or the same group as $R_1$ and each $R_3$, which may be the same or different groups, is hydrogen or an alkyl group; and 2. a singlet oxygen quencher.

Suitable compounds of the above general formula I are those in which $R_1$ is an alkyl group comprised of from one to twenty carbon atoms, a secondary alkyl group comprised of from three to six carbon atoms being particularly preferred. Examples of preferred secondary alkyl groups are secondary propyl, secondary butyl, secondary pentyl and secondary hexyl groups with a secondary butyl group being most preferred. Preferably $R_2$ is the same group as $R_1$ and preferably each $R_3$ group is a hydrogen atom. A particularly preferred compound is N,N'-di-secondarybutyl-p-phenylene diamine.

The amount of compound of general formula I which may be added to the hydroprocessed base oil may vary considerably but is usually added in amounts of from 0.0001 to 2.0% weight, preferably from 0.001 to 0.5 % weight, based on weight of hydroprocessed base oil.

The singlet oxygen quenchers for use in the above compositions are solid or liquid materials capable of converting singlet oxygen from its excited state (singlet oxygen) to its ground state (triplet oxygen). While not wishing to be bound by the theory, it is now believed that in hydroprocessed base oils, certain components of unknown structure but generally called sensitizers, are electronically excited by short wavelength light and carry over part of their excitation energy to triplet oxygen thereby converting it into singlet oxygen. This singlet oxygen may undergo chemical reaction with components of the oil and produce any or all of the following effects in the oil: darkening the color, haze formation, and sludge formation. Singlet oxygen quenchers are compounds which convert singlet oxygen physically or chemically into triplet oxygen thereby preventing the singlet oxygen from these further chemical reactions.

The phenomena associated with singlet oxygen quenching and compositions which exhibit singlet oxygen quencher properties are well known in the art being disclosed for example in "Physical and Chemical Properties of Singlet Molecular Oxygen" by D. R. Kearns, Chemical Reviews, 1971, vol. 71, No. 4, pages 395–427, and from "Some Aspects of Stabilization of Polymers Against Light" by H. J. Heller and H. R. Blattman, Pure Applied Chemistry, Vol. 36, p. 141, 1973.

Examples of suitable singlet oxygen quenchers are carotenes, such as beta-carotene; and aliphatic amines, such as aliphatic tertiary amines or aliphatic primary or secondary amines in which at least one of the aliphatic groups has a tertiary alpha carbon atom or heterocyclic amines.

Suitable tertiary aliphatic amines are trialkylamines, wherein each alkyl group comprises from one to twenty carbon atoms and esters of trialkanolamines wherein the carboxylic group comprises from one to twenty carbon atoms. Specific examples of trialkylamines are trimethyl, triethyl, tripropyl, tributyl, tripentyl, trihexyl, dimethyloctadecyl, dimethyldodecyl, didodecylethyl, and dioctadecylethylamines. The tristerate of triethanolamine is an example of an ester of a trialkanolamine.

Suitable primary amines in which the aliphatic group has a tertiary alpha carbon atom are tertiary monoalkyl primary amines comprised of from four to twenty-five carbon atoms. Specific examples are tertiary butyl, pentyl, hexyl, heptyl, octyl, nonyl, decyl, undecyl and dodecyl primary amines. A particularly useful mixture of compounds is a mixture of tertiary alkyl primary amines comprised of from eighteen to twenty-two carbon atoms.

Also suitable quenchers are heterocyclic amines which may be saturated or unsaturated, substituted or unsubstituted. The heterocyclic amines are generally 4–8 membered rings comprising at least one and as many as four nitrogen atoms and from zero to three other hetero-atoms selected from the class of oxygen, sulfur and phosphorous.

Heterocyclic amines include pyrrolidine piperidine, imidazole, pyridine, 1,4-diaza-[2,2,2]-bicyclooctane, morpholine and substituted derivatives thereof. Other suitable heterocyclic amines are alkyl substituted piperidine, wherein the alkyl group comprises from one to twenty carbon atoms, for instance 2-(2-methyl octadecyl)piperidine, alkyl substituted imidazoles, wherein the alkyl group comprises from one to twenty carbon atoms, for instance 1-ethyl imidazole and N-substituted morpholines, e.g. N-methyl morpholine and N-[2-isostearoyloxyethyl]-morpholine. The preferred heterocyclic amine is 1,4-diaza-[2,2,2]-bicyclooctane.

The amount of singlet oxygen quencher which may be added to the base oil may vary considerably but is usually present in small amounts. Suitable amounts are from 0.0001 to 1.0% weight. The preferred amount of singlet oxygen quencher is from 0.0001 to 0.5 weight. The amounts are based on weight of hydroprocessed base oil.

The base oil compositions according to the invention may also contain other additives such as viscosity index improvers, anti-wear additives, extreme pressure additives, detergents and pour-point depressants.

The invention will now be illustrated by the following examples.

In the examples the daylight stability of the base oils or base oil compositions was determined by an artificial daylight stability test. In this test, Pyrex ASTM pour-point test tubes containing 30 grams of the oil are placed in a compartment maintained at 35° ± 0.5° C. The test tubes are then irradiated by two fluorescent tubes (Philips TL 40W/57) and the times taken for either haze or sludge formation to occur in the oils is noted.

In the examples, the following lubricating base oils were used.

Base Oil A

A hydrocracked and hydrofinished vacuum distillate having a viscosity of about 5.5 centistokes at 210° F and a viscosity index of about 130.

Base Oil B

A hydrocracked and hydrofinished deasphalted short residue having a viscosity of about 9 centistokes at 210° F and a viscosity index of about 130.

Base Oil C

A hydrocracked and hydrofinished vacuum distillate having a viscosity of 4.5 centistokes at 210° F and a viscosity index of about 95.

Base Oil D

A hydrocracked and hydrofinished vacuum distillate having a viscosity of about 7 centistokes at 210° F and viscosity index of about 95.

Base Oil E

A hydrocracked and hydrofinished vacuum distillate having a viscosity of about 11.5 centistokes at 210° F and a viscosity index of about 95.

EXAMPLE 1

In this example, combinations of different singlet oxygen quenchers (SOQ) and N,N'-di-secondarybutyl-p-phenylenediamine, (A), commercially available under the tradename Topanol M, were added to base oils E and B to produce base oil compositions according to the invention. The types and amount of SOQ as well as the amount of A added in each run are given in Table I. The amounts are based on the weight of base oil.

The base oils and base oil composition were subjected to the artificial daylight stability test and the results are given in Table I.

Table I

| Run No. | Type of base oil | Type of SOQ | Amount of SOQ (%w) | Amount of A (%w) | Time at which haze or sludge first appears (days) |
|---|---|---|---|---|---|
| 1 | E | — | — | — | 1 |
| 2 | E | $C_{18-22}$ tertiary alkylprimaryamine mixture (a) | 0.1 | 0.001 | 7 |
| 3 | E | $C_{11-14}$ tertiary alkylprimaryamine mixture (b) | 0.1 | 0.001 | 4 |
| 4 | E | tertiary octyl-primaryamine | 0.1 | 0.001 | 4 |
| 5 | B | — | — | — | 2 |
| 6 | B | dimethyldodecyl-amine | 0.1 | 0.001 | 7 |
| 7 | B | tributylamine | 0.1 | 0.001 | 7 |
| 8 | B | 1,4-diaza-[2,2,2]-bicyclooctane | 0.1 | 0.001 | 4 |
| 9 | B | $C_{18-22}$ tertiary alkylprimaryamine mixture | 0.1 | 0.001 | 7 |

(a) Commercially known as "Primene-JMT".
(b) Commercially known as "Primene 81-R".

EXAMPLE 2

In this example, various amounts of beta-carotene and N,N'-disecondarybutyl-p-phenylene diamine, (A), were added to various base oils to produce base oil compositions according to the invention. The base oils and the base oil compositions were subjected to the artificial daylight stability test. The results are given in Table II along with the amounts of beta-carotene and A added in each run. The amounts are based on the weight of base oil.

Table II

| Run No. | Type of base oil | Amount of betacarotene (%w) | Amount of A (%w) | Time at which haze or sludge first appears (days) |
|---|---|---|---|---|
| 1 | C | — | — | 3 |
| 2 | C | 0.001 | 0.001 | 5 |
| 3 | A | — | — | 2 |
| 4 | A | 0.001 | 0.001 | 5 |
| 5 | B | — | — | 2 |
| 6 | B | 0.001 | 0.001 | 8 |
| 7 | D | — | — | 1 |
| 8 | D | 0.001 | 0.001 | 5 |
| 9 | E | — | — | 1 |
| 10 | E | 0.001 | 0.001 | 4 |

What is claimed is:

1. A base oil composition comprising a major portion of a hydroprocessed base oil and a daylight stability enhancing amount of 1. a compound of the general formula:

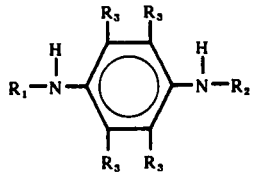

(I)

wherein $R_1$ is a substituted or unsubstituted aliphatic, aromatic or a four to eight member heterocyclic group comprised of from one to five hetero-atoms selected from the class of nitrogen, oxygen, phosphorus and sulfur; $R_2$ is hydrogen or the same group as $R_1$, and each $R_3$, which may be the same or different, is selected from the class consisting of hydrogen and an alkyl group of from one to six carbon atoms; and 2. a singlet oxygen quencher.

2. The composition of claim 1 wherein $R_1$ is an alkyl group comprised of from one to twenty carbon atoms.

3. The composition of claim 2 wherein $R_1$ is a secondary alkyl group.

4. The composition of claim 3 wherein $R_2$ is the same group as $R_1$.

5. The composition of claim 4 wherein $R_3$ is hydrogen.

6. The composition of claim 1 wherein the amount of the compound of general formula I is from 0.0001 to 0.05% weight and the amount of singlet oxygen quencher is from 0.0001 to 0.5% weight based on the weight of hydroprocessed base oil.

7. The composition of claim 1 wherein the compound of general formula I is N,N'-di-secondarybutyl-p-phenylene-diamine.

8. The composition of claim 1 wherein the singlet oxygen quencher is selected from the class consisting of carotenes, aliphatic amines, and substituted or unsubstituted heterocyclic amines in which the heterocyclic ring contains from four to eight atoms and is comprised of at least one and up to four nitrogen hetero-atoms and from zero to three other hetero-atoms selected from the class consisting of oxygen, sulfur and phosphorus.

9. The composition of claim 8 wherein the singlet oxygen quencher is beta-carotene.

10. The composition of claim 8 wherein the singlet oxygen quencher is an aliphatic tertiary amine, wherein each alkyl radical of the tertiary amine is comprised of from one to twenty carbon atoms.

11. The composition of claim 8 wherein the singlet oxygen quencher is an aliphatic primary amine and the aliphatic group contains a tertiary alpha carbon atom.

12. The composition of claim 11 wherein the singlet oxygen quencher is a tertiary alkyl primary amine comprised of from four to twenty-five carbon atoms.

13. The composition of claim 8 wherein the singlet oxygen quencher is a secondary aliphatic amine and 1–2 of the aliphatic groups contain a tertiary alpha carbon atom.

14. The composition of claim 8 wherein the singlet oxygen quencher is an alkyl heterocyclic amine wherein the alkyl substituent is comprised of from one to twenty carbon atoms.

15. The composition of claim 8 wherein the singlet oxygen quencher is 1,4-diaza-[2,2,2]-bicyclooctane.

16. The composition of claim 1 wherein the hydroprocessed base oil is selected from a class consisting of hydrocracked base oils and hydrocracked and hydrofinished base oils.

17. The composition of claim 1 wherein the hydroprocessed base oil has a viscosity index in the range of from 80 to 155.

18. The composition of claim 1 wherein the hydroprocessed base oil is a lubricating oil.

* * * * *